US010774498B2

(12) United States Patent
Frey et al.

(10) Patent No.: US 10,774,498 B2
(45) **Date of Patent: *Sep. 15, 2020**

(54) ROBUST MULTI-TOOL ASSEMBLY FOR HYDRAULIC EXCAVATORS

(71) Applicant: AMI ATTACHMENTS INC., Hawksville (CA)

(72) Inventors: Steven Oscar Frey, Elmira (CA); Dwight Colin Myer, Drayton (CA)

(73) Assignee: AMI Attachments Inc., Hawksville, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/087,428

(22) PCT Filed: Mar. 23, 2017

(86) PCT No.: PCT/CA2017/050369

§ 371 (c)(1),
(2) Date: Sep. 21, 2018

(87) PCT Pub. No.: WO2017/161458

PCT Pub. Date: Sep. 28, 2017

(65) Prior Publication Data

US 2019/0100896 A1 Apr. 4, 2019

(30) Foreign Application Priority Data

Mar. 23, 2016 (GB) ..... 1604983.5

(51) Int. Cl.
*E02F 3/40* (2006.01)
*E02F 3/36* (2006.01)

(52) U.S. Cl.
CPC ..... *E02F 3/3622* (2013.01); *E02F 3/365* (2013.01); *E02F 3/3663* (2013.01); *E02F 3/404* (2013.01)

(58) Field of Classification Search
CPC ..... E02F 3/404; E02F 3/413–4136
See application file for complete search history.

(56) References Cited

U.S. PATENT DOCUMENTS 3,250,028 A * 5/1966 Hunger ..... E02F 3/404 37/406
4,285,628 A * 8/1981 Jankowski ..... E02F 3/404 37/406

(Continued)

FOREIGN PATENT DOCUMENTS

DE 102014218652 3/2016
EP 1837445 9/2007

(Continued)

OTHER PUBLICATIONS

Internarional Searching Aughority, Written Opinion and International Search Report dated Jun. 9, 2017, from corresponding PCT Patent Application Serial No. PCT/CA2017/0580369, filed Mar. 9, 2017.

(Continued)

*Primary Examiner* — Thomas B Will
*Assistant Examiner* — Joan D Misa
(74) *Attorney, Agent, or Firm* — Bereskin & Parr LLP

(57) ABSTRACT

A hydraulic excavator tool adapted to be secured to the distal working end of an excavator boom including a main tool assembly with a tool framework, a spaced apart pair of connection flanges fast with the tool framework, and, a structural tubular casing integral with the tool framework extending across and through the tool framework and through the flanges, plus a rotary hydraulic actuator within the tubular casing extending between the connection flanges and providing a rotational drive motion to a drive axle extending between the connection flanges adapted to provide a controlled rotary drive motion of the axle adjacent the connection flanges, and a working tool framework fast to the (Continued)

axle adjacent each of the connection flanges for relative controlled rotation of the working tool framework about the drive axle between the tool framework and a working position.

16 Claims, 7 Drawing Sheets

(56) References Cited

U.S. PATENT DOCUMENTS

| | | | | |
|---|---|---|---|---|
| 4,799,852 | A * | 1/1989 | Ramun | E02F 3/404 37/406 |
| 5,549,440 | A * | 8/1996 | Cholakon | E02F 3/3622 37/468 |
| 5,649,377 | A * | 7/1997 | Tanada | E02F 3/3681 37/406 |
| 6,158,950 | A * | 12/2000 | Wilt | E02F 3/3622 37/468 |
| 6,212,889 | B1 * | 4/2001 | Martin | F15B 15/068 60/602 |
| 6,287,072 | B1 * | 9/2001 | Wasilas | E02F 3/404 37/406 |
| 6,308,442 | B1 * | 10/2001 | Naka | E02F 3/3622 37/468 |
| 6,370,801 | B1 | 4/2002 | Weyer et al. | |
| 6,612,051 | B2 * | 9/2003 | Weyer | E02F 3/404 37/406 |
| 6,742,291 | B2 * | 6/2004 | Frigon | E02F 3/404 37/406 |
| 8,469,623 | B2 * | 6/2013 | Luyendijk | E02F 3/364 37/468 |
| 8,695,239 | B2 * | 4/2014 | Seda | E02F 3/96 37/406 |
| 8,727,252 | B1 * | 5/2014 | Phipps | E02F 3/965 241/101.73 |
| 8,966,792 | B2 * | 3/2015 | Bienfang | E02F 3/4075 37/445 |
| 9,228,314 | B2 * | 1/2016 | Robl | E02F 3/3663 |
| 9,394,926 | B1 * | 7/2016 | Cui | F15B 15/068 |
| 9,476,433 | B2 * | 10/2016 | Jang | F15B 15/068 |
| 9,481,978 | B2 * | 11/2016 | Seda | E02F 3/96 |
| 9,809,946 | B2 * | 11/2017 | Van Gemert | E02F 3/3622 |
| 9,976,280 | B2 * | 5/2018 | Honermann | E02F 3/4135 |
| 2003/0095858 | A1 * | 5/2003 | Mantovani | E02F 3/3618 414/723 |
| 2003/0154636 | A1 * | 8/2003 | Miller | E02F 3/3618 37/468 |
| 2004/0000811 | A1 | 1/2004 | Kehler | |
| 2008/0016729 | A1 * | 1/2008 | Holp | E02F 3/248 37/443 |
| 2010/0254755 | A1 | 10/2010 | Luyendijk et al. | |
| 2012/0189380 | A1 | 7/2012 | Doherty et al. | |

FOREIGN PATENT DOCUMENTS

| | | | | |
|---|---|---|---|---|
| JP | 60261835 A * | 12/1985 | | E02F 3/404 |
| KR | 20130142001 | 12/2013 | | |

OTHER PUBLICATIONS

AMI Attachments—Graptor—Integrated Thumb Bucket, made public on Jun. 22, 2015 by Heavy Equipment Guide, http://www.heavyequipmentguide.ca/article/21107/ami-attachments-graptor-integrated-thumb-bucket.

AMI Attachments. Facebook [online] [picture] [retrieved Nov. 30, 2012]. Retrieved from <https://www.facebook.com/AmiAttachments/photos/a.117342495064394/225545460910763/?type=3&theater>.

AMI Attachments. Facebook [online] [picture] [retrieved Apr. 19, 2013]. Retrieved from <https://www.facebook.com/AmiAttachments/photos/a.117342495064394/298168593648449/?type=3&theater>.

AMI Attachments. Facebook [online] [picture] [retrieved Mar. 6, 2015]. Retrieved from <https://www.facebook.com/AmiAttachments/photos/pcb.630955007036471/630954217036550/?type=3&theater>.

National Heavy Equipment Show. Facebook [online] [picture] [retrieved Mar. 9, 2015]. Retrieved from <https://www.facebook.com/NationalHeavyEquipmentShow/photos/a.1068328819850881/1068329203 184176/?type=3&theater>.

National Heavy Equipment Show. Facebook [online] [picture] [retrieved Mar. 9, 2015]. Retrieved from <https://www.facebook.com/NationalHeavyEquipmentShow/photos/a.1068328819850881/1068329173 184179/?type=3&theater>.

AMI Attachments. Every Job Has its Challenges. YouTu be [online] [video] [retrieved Oct. 15, 2014]. Retrieved from <https://www.youtube.com/watch?v=sCl0C7fQtQl>.

* cited by examiner 1
2
3
4
5
6
7
8
9
10
11
12
13
14
15
16
17
18
29
40
A
B

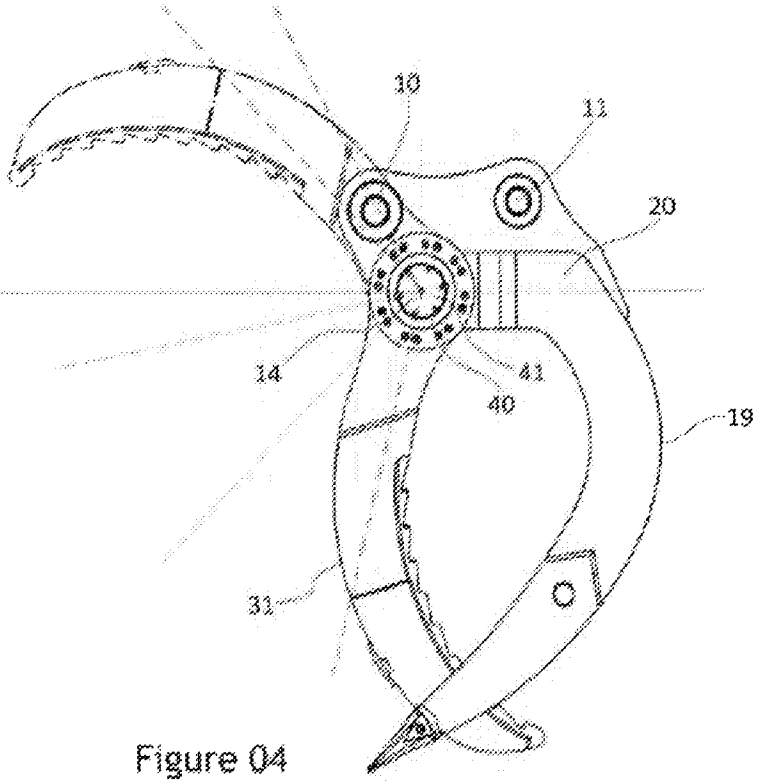
Figure 04
Figure 03
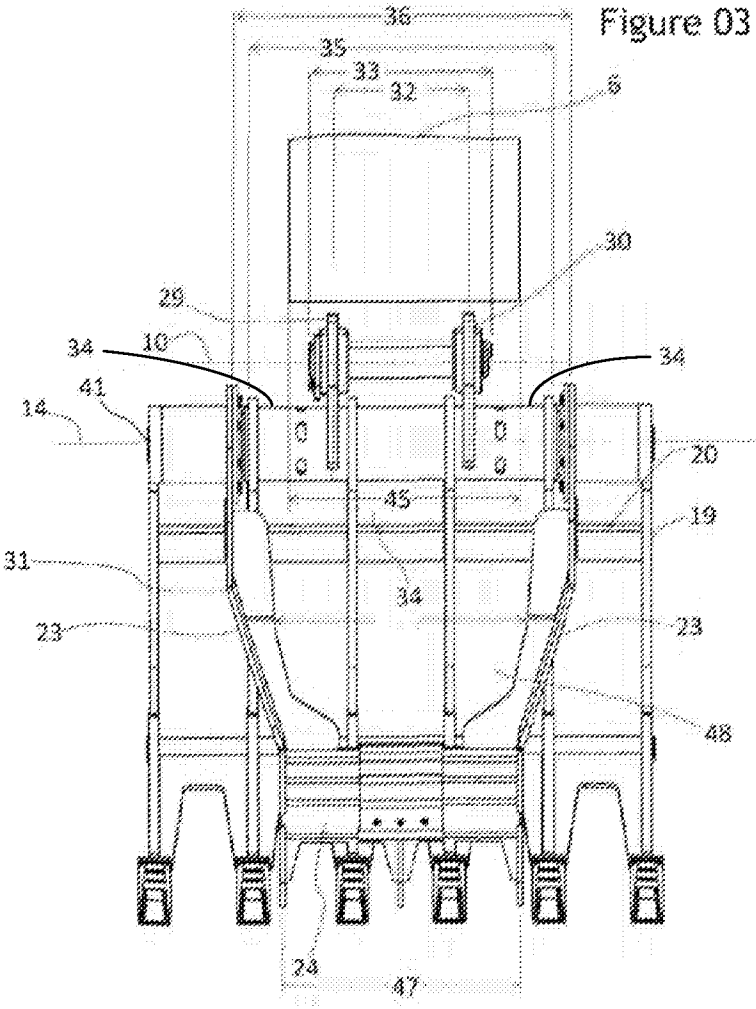

6
14
23
34
40
41
42
43
44
45
46
47
49
32
35
36
A
A

CLAW GRABBING HOOK BOLTED TO
ACTUATOR HUBS AND AXLE AT EACH END

ROBUST MULTI-TOOL ASSEMBLY FOR HYDRAULIC EXCAVATORS

PRIORITY

This application claims priority based upon GB provisional applications:

GB-1604983.5, filed 23 Mar. 2016, and,

GB-1701204.8, filed 24 Jan. 2017,

FIELD OF THE INVENTION

This invention provides a multiple tool assembly relating to rotatable tools secured to the working distal boom end of hydraulic excavators for controlled relative rotation between a working tool and the assembly framework.

BACKGROUND

The overall form of a hydraulic excavator has been well known for decades. There are many examples of such excavators with a 2-boom stick hydraulically and rotationally secured to work within in a vertical plane, itself rotatable about a vertical axis coincident with a engine/cab combination mounted to a pair of tracks. The position and movement of the distal working end of the stick is controlled typically from a operator's cab mounted on the excavator. Although this general design profile is common, the range of sizes and shapes varies considerably due to the type and extent of work to be conducted.

The most common working tool used with a hydraulic excavator, among many, is a digging bucket rotatably secured to the distal end of the stick for rotation about a horizontal axis. The bucket is independently hydraulically driven in rotation about the horizontal axis by a cylinder positioned to apply hydraulic force between the stick and the bucket. The power of such machines and the amount of energy involved has and continues to increase with increasingly larger, heavier and more difficult materials and includes not only digging but also breaking and shearing, among others. Generally the bucket cylinder and its related hydraulic lines and connections are positioned on the outside of the stick well away from the working parts of the bucket and its various motions. The outside is that part of the operating range which lies outside of the work area between the stick/bucket and an engine/cab.

Necessarily, hydraulic excavators are designed to carry out a broad range of construction and demolition duties in extremely adverse and highly variable conditions, including high impact loading during initial contacts and continuing work, abrasive debris and severe vibration while working in all manner of solid, semi-solid and liquidy or mixed materials. Any tool failure or work failure is not only unacceptable but also very dangerous and must occur under tightly controlled conditions. Typically the operator is or prefers to concentrating on the machine interaction with the work area and not exclusively the moving parts of the excavator other than the actual working tool. As such, operational conditions, with or without error or failure, and with or without high energy events.

The variety of work types and conditions is exacerbated by location of the work which is often far beyond the reach of support or repair opportunities and even, on occasion, far beyond immediate accident support.

In many cases the work being done or which could be done would be facilitated by expanded flexibility in the form and use of the excavator as a whole and by an increase in the speed and continuity of operations. Thus, modern excavators are available with multiple working tools and with quick-connect mounting components adapted for rapid and operator-free changing of at least the primary working tool.

While convenient, these requirements bring about mechanical complexity as the bucket or other primary working tool is no longer a permanent fixture at the distal end of the stick. Consequently it is advantageous to secure as many moving parts, particularly relatively fragile and expensive hydraulic parts against the harsh environment in which they are called to operate.

To increase utility, in the past traditional bucket arrangements have been coupled with additional support tools such as thumb-like arrangements which operate to secure materials within and against the body of the bucket. Of these, there have been several common types, including:

1. a fixed retractable thumb secured to the stick,
2. a hydraulic thumb secured between the stick and the bucket for rotation about a single horizontal axis on the stick. The bucket and thumb are in relative rotation and motion during working and carriage of a load.
3. a stick pivot thumb where the thumb rotates on the same pivot point as the original bucket pin, not a secondary weld-on pivot point. A hydraulic cylinder is also directly connected between the thumb and the stick, providing rotation in relation to the bucket. The thumb and the bucket pivot on the same axis providing for maintenance of a constant grip on the load with suitable hydraulic circuits. The pivot eliminates scraping and slippage and reduces risk of release during rotation, reducing complexity, and,
4. more recently a hydraulic thumb secured to the bucket for rotation about a horizontal bucket axis driven by a hydraulic cylinder operating between the thumb and the sick.

OBJECTS

It is an object of the invention to provide a more robust multi-tool assembly for use with heavy duty hydraulic excavators.

It is a further object to provide an excavator working tool assembly with expanded utility.

It is a another object to provide particularly, a rake or bucket tool assembly for secure mounting to an excavator stick which assembly includes a separately pivotable thumb, whereby the range of rotation of a thumb is greatly increased while maintaining operating components, particularly bearing surfaces and thumb components, in a protected position while within the work area under control of relative movement.

It is a further object to provide a method and procedure for improving the range of motion and utility of multi-use excavator tools while maintaining the robust character of the main working tool.

It is a still further object to provide for minimal extra components and minimal interference with bucket or machine operations while isolating thumb components from the full range of the harshest uses of the main working tool.

It is yet another object to provide a tool including a rotary hydraulic drive cylinder positioned securely within boundary walls. The exterior armor protects the moving hydraulic parts and flexible lines from the serve working environment to which excavators and their working tools are routinely subjected to. Manufacturing tolerances, and tool variety dictate that tool parts may be spaced apart by a significant and variable distance.

Exposure of hydraulic cylinders and lines to severe environments such as excavator operations is a condition to be avoided. Typical hydraulic cylinders completely expose their hydraulic seals and piston rods to these conditions and full protection is difficult to achieve and expensive to implement while making the attachment tool itself cumbersome and heavy, thereby interfering with the ongoing excavator work.

It is an object of the invention to reduce excavator tool complexity and cost, reduce size where possible, increase utility across a wider variety of excavator types and models and all the while maintaining rigorous protection protocols in respect of system hydraulics and providing simple controlled operations.

It is an object of the invention to provide an excavator tool capable operating in the most demanding conditions for long periods and far from maintenance and repair facilities as the slightest interruption of work schedules by failure or even simple tool switching can be extremely expensive and ruinous to production schedules in such conditions, or elsewhere.

THE INVENTION

The invention provides a hydraulic excavator tool adapted to be secured to the distal working end of an excavator boom comprising

- a main tool assembly including a tool framework, a spaced apart pair of connection flanges fast with said tool framework, and, a structural tubular casing integral with the tool framework extending across and through the tool framework and through the flanges, plus
- a rotary hydraulic actuator within the tubular casing extending between the connection flanges and adapted to provide a rotational drive motion of a drive axle extending between the connection flanges adapted to provide a rotary drive motion of the axle adjacent the connection flanges, and
- a working tool framework fast to the axle adjacent each of the connection flanges for rotation of the working tool framework about the drive axle between the tool framework and a working position.

The invention also provides a hydraulic excavator tool with the rotary actuator fast with the tubular casing adjacent both of the connection flanges to support the drive axle adjacent both of the connection flanges.

The invention also includes a working tool skeletal framework with a pair of working arms spaced apart along the direction of the axle by at least the length of the tubular casing, each fast to the axle, and a working tool remote from the axle spaced apart by the length of the tubular casing.

Further the invention provides the axle lying between the working tool and the distal working end of an excavator boom and controlled rotation of more that 45, 60 and 90 degrees relative between the working tool and tool framework.

The invention also provides an excavator bucket tool with a controlled rotation thumb tool for relative controlled rotation between the bucket the the thumb about an axle integral with the bucket and between the bucket mount to the distal working end of the bucket and the working teeth.

Similarly, controlled and protected rotation about such an tool mounted axle is provided for rake tools and tool couplers.

DRAWINGS

FIGS. 03 and 04 are front and side elevations of a variation of the the rake tool assembly of FIG. 02 shown the tool in fully closed, pinching, partially open and fully open condition in dotted relief in FIG. 04.

THE PREFERRED EMBODIMENTS

Figures 1, 1A, 1B:
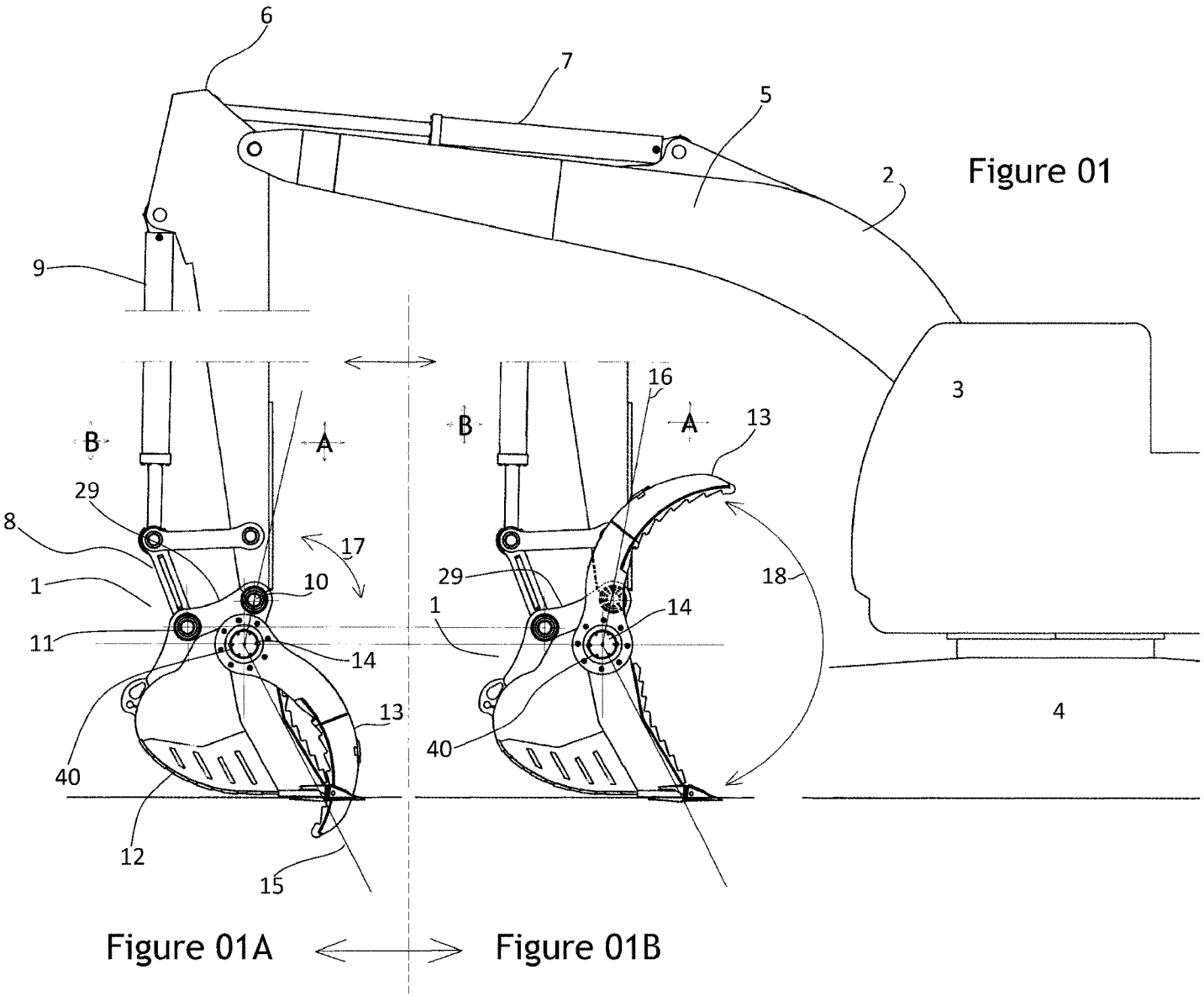
FIG. 01 is an elevation view of the bucket tool assembly embodiment of the invention in in-use conditions separately shown in sub-FIGS. 01A and 01B depicting the thumb-bucket combination secured to the distal working end of the excavator boom in fully closed and fully open condition, respectively.

The hydraulic excavator 2 tool 1 of the invention is shown in a side elevation view in FIG. 01 configured as a bucket 12 plus a gripper thumb 13 connected for controlled relative rotation about axle 14 separate from the main bucket axes of work 10 and 11. FIG. 01*a* shows the thumb 13 in a fully closed position which FIG. 01*b* shown the thumb in the full open position.

All of the operating requirements for the tool assembly 1 are within the working area A between the cab 3, tracks 4, the primary arm or stick 5 and the secondary arm or stick 6 of the excavator while none of these are in the external area B. Tool assembly 1 is operated hydraulically from the cab completely independently of the bucket 12 or the secondary arm 6 or their operating or connecting linkages and thus is under separate operator control.

As is commonly the case, rotation of stick 5 about stick 6 is driven and maintained by linear hydraulic cylinder 7. Similarly, stick 6 includes a further secondary linear hydraulic cylinder 9 adapted to drive and maintain bucket 12 in rotation about stick 6. Notably both cylinders and related bearings and linkages 7 and 9 are fully within external area B and are fully protected from work area A by the body of each of the sticks 5 and 9 respectively.

Main working tool 1 of the bucket embodiment is secured to secondary stick 6 for pivotal movement about horizontal working axis 10. The angular position of bucket 1 in respect of stick 6 is driven and maintained by tool linkage 8 mounted between cylinder 9 and a bucket drive horizontal working axis 11 in a traditional and well-known manner which is very comfortable for use by the excavator operator. Axes 10 and 11 are parallel to each other and fitted with very robust bearings.

Thumb 13 is mounted to the bucket tool assembly about a 3rd parallel and horizontal axis of rotation 14. Preferably, bucket axis 14 is between the mounting axes 10 and 11 and the distal working end of the bucket tool. Mounting the thumb 13 to the bucket 1 separates the thumb and its mechanisms from the harshest of the work activity carried out by the excavator and bucket combination as it may be independently rotated from a fully engaged position along line 15 in FIG. 01A to a fully open or disengaged position along line 16 as shown in FIG. 01B.

The range to open is as shown at item 17 in FIG. 01A and as item 18 in FIG. 01B as a range to close.

Figure 2:
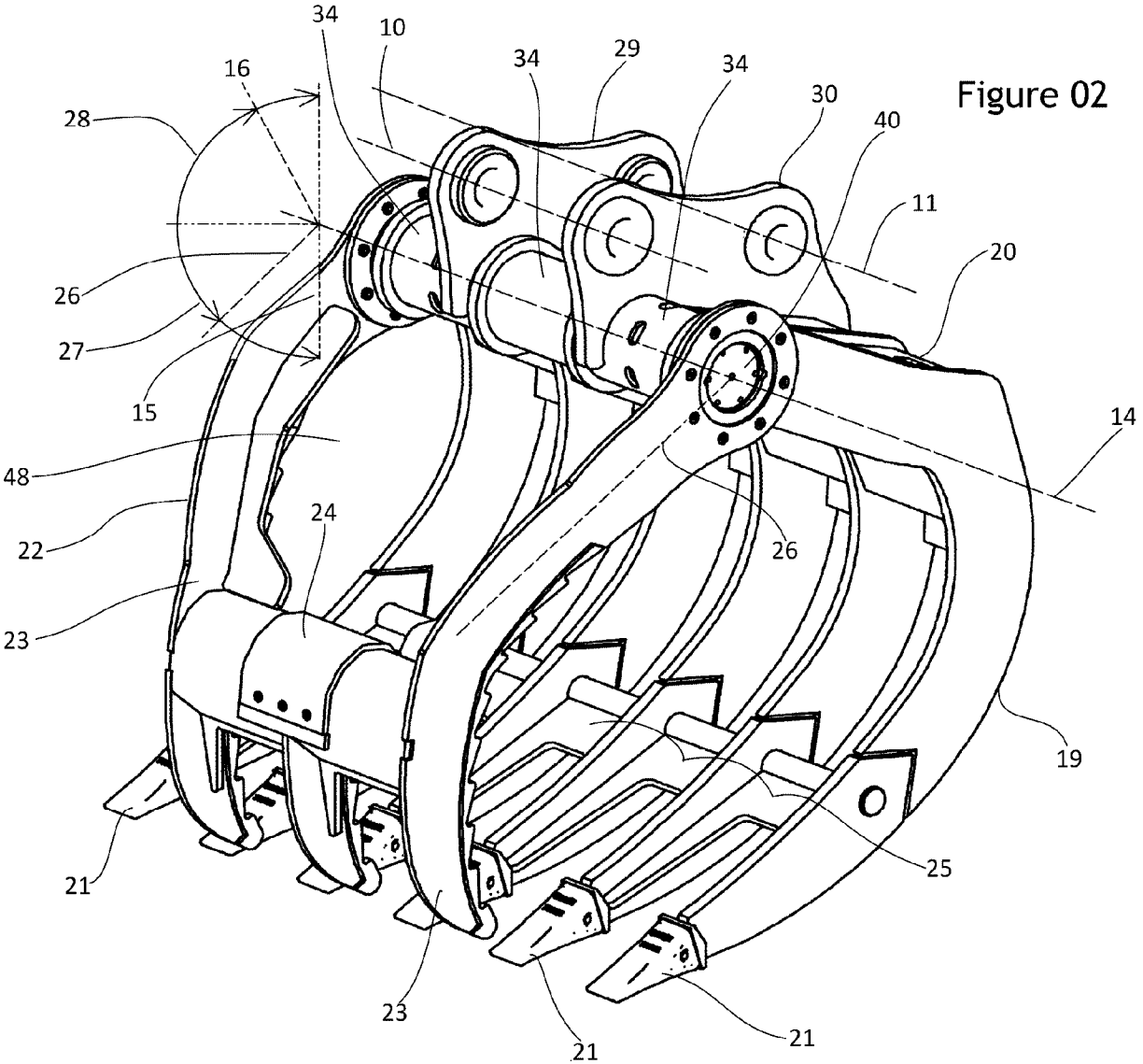
FIG. 02 is a perspective view of the working tool assembly of FIG. 01 adapted in to a rake configuration.

The working tool assembly of the invention is shown in the rake tool 19 embodiment depicted in a partially open perspective view in FIG. 02.

The rake tool 19 includes a rake frame 20 and a plurality of extending rake tines 21 monolithic with the frame 20, a pair of tool mount flanges 29 and 30 and a drive casing 34. As with FIG. 01, tool mount flanges 29 and 30 provide for horizontal pivot axes 10 and 11 and for a quick tool change between a bucket tool of FIG. 01 and the rake tool of FIG. 02 without interference with thumb components.

Drive casing 34 is a hollow tubulal structural element tool of rake frame 20, as by welding, and extends across a substantial proportion of the width of the rake tool 19 so as to include both mounting connecting flanges 29 and 30 and the rake frame 20.

The rake tool 19 may include an inter-tine support framework 25 adjacent the working tips.

The thumb 22 is shown in partially open angular position depicted along line 26.

Thumb 22 includes a pair of spaced apart arms 26 monolithic with a horizontal drive rotary hydraulic cylinder for pivotal motion in respect of tool 19 about transverse axis 14 central to the drive cylinder and the drive casing 34.

Thumb may be driven closed along arc 27 towards a fully closed position depicted by line 15 or driven open along arc 28 towards a fully open position depicted at line 16 or even further in rotation.

Thumb 22 also includes a thumb framework 24 extending between arms 23.

Thumb 22 encompasses a fully open relief spacing 48 between the arms 23, the thumb framework 24 and the tool frame 20 as it is mounted to the rotary drive at points external to both the drive casing 34 and the tool framework 20.

FIGS. 03 and 04 show a frontal and side elevation of a variant upon the rake tool of FIG. 02 shown in fully closed position 31 and an open position in dotted relief in FIG. 04.

In the embodiment of FIGS. 03 and 04 the structural casing 34 extends only to a width 35 just slightly less that the inter-arm spacing 36 of thumb arms 23.

As can be seen, spacing 32 between flanges 29 and 30, including mounting hardware 33, is fully within the length 35 of casing 64 and also within the nominal width 45 of secondary stick 6.

Since thumb arm width 35 is greater than stick width 45 the thumb 13 is able to rotate from the fully closed position of FIGS. 03 and 04 to an open position shown in dotted relief if FIG. 04 as line 26 rotates through arc 28 to a first open position 16*a* and further to open position 16*b* whereat the arms 23 have rotated to the fullest extent past the outer boundaries of stick 6 until rake framework 24 contacts stick 6. As can be seen, the extent of rotation will vary depending upon the particular embodiment being designed as a smaller thumb frame 24 or longer arms 23 will provide for a larger inter-arm spacing 48

Figures 5, 6:
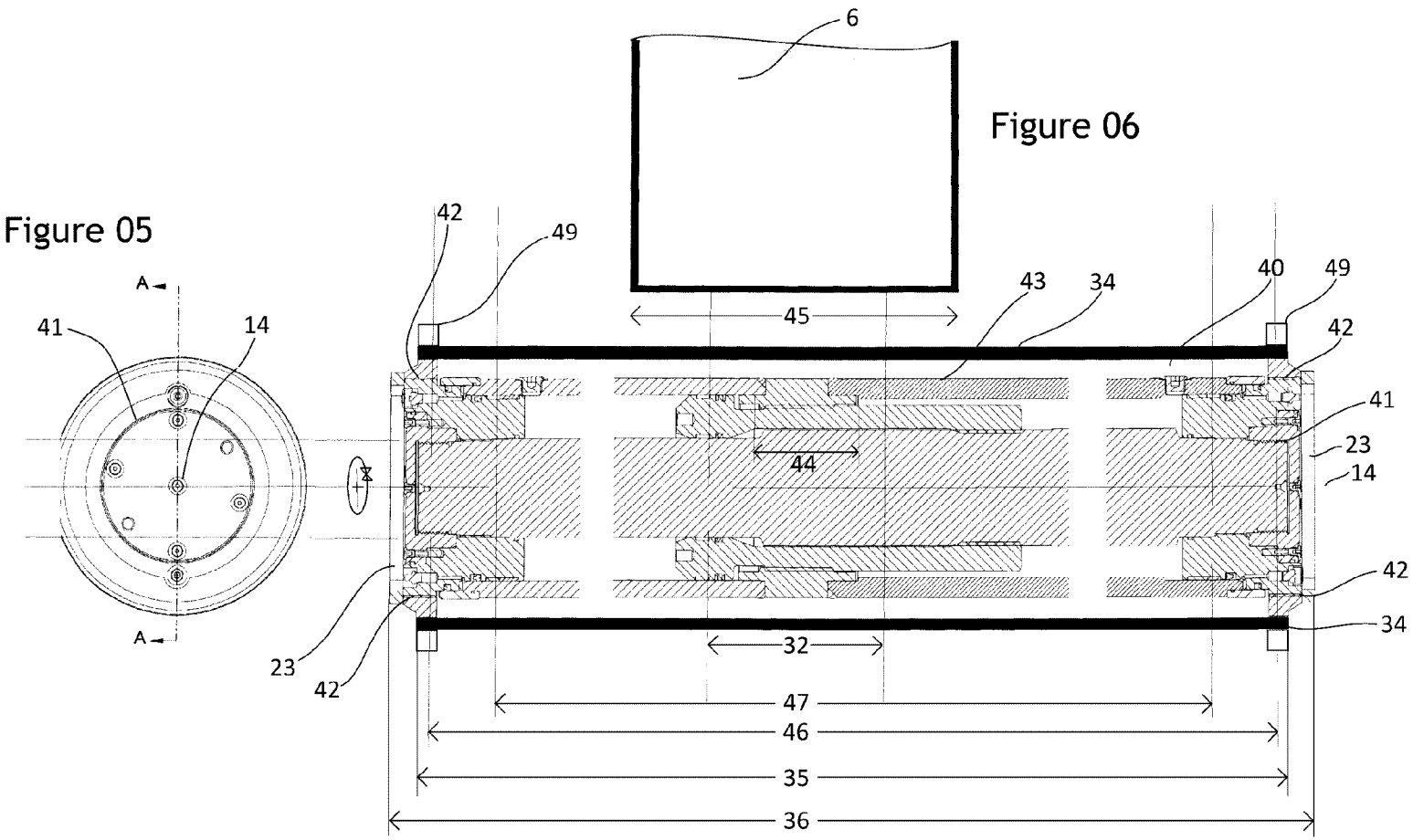
FIG. 05 is an end view of the structural tube and encased rotary hydraulic actuator of FIGS. 01 through 04 the invention.
FIG. 06 is a cross-sectional view of the tube and actuator of FIG. 05 taken along line A-A in FIG. 05 and showing the spatial relationship with the secondary arm of a hydraulic excavator.

FIGS. 05 and 06 are an end elevation of the rotary actuator and a cross-section taken along line A-A of FIG. 05 in FIG. 06.

Rotary actuator 40 is generally cylindrical and is mounted monolithically, as by welding, into structural casing tube 34 at least at its horizontal extremities 49 so that non-axially aligned stresses are transmitted through to casing 34 and then the more robust elements of the tool framework and the excavator. Arms 23 are secured to opposite ends of the rotary actuator for rotation on the actuator horizontal axis 14. Actuator axle bearings 42 are thus in close proximity to extremities 49. Arm spacing 36 is shown close coupled to casing length 35.

Hydraulic drive lines may be fully engaged outside of work area B and connect through casing 34. Engagement of hydraulic pressure drives the piston laterally in direction 44 and thus along a spline to rotate axle 41 in either direction through a broad arc as in 28 or larger.

The tool coupler embodiment of the invention is shown in FIGS. 07 through 10 with independent numbering corresponding in element type or function to FIGS. 01 through 06.

Figure 7:
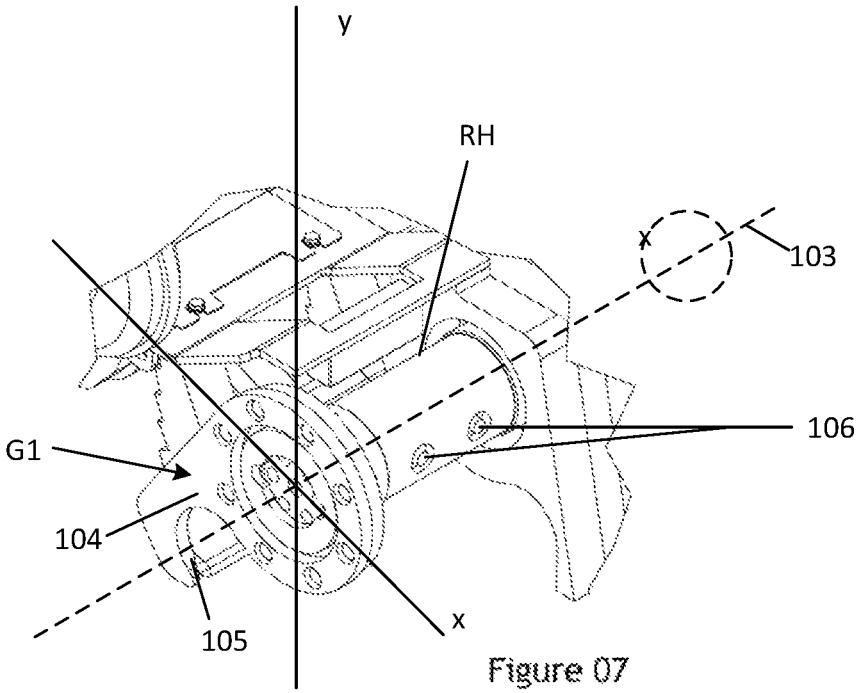
FIG. 07 is a partial perspective view of the rotary tool coupler embodiment of the invention.

Rotary hydraulic drive cylinder is welded into a protective cylindrical sleeve to form rotary cylinder arrangement RH as in FIG. 07 preferably at weldment points 106. Claw G1 from FIG. 07 is formed of an opposing pair of grapple claws 104 and 107 (see FIG. 10) with engagement teeth 105, one affixed at each end of the central x-y axis of arrangement RH for rotation about axis 103 which corresponds to axis 14 in FIG. 01 through 06.

As can be seen in FIG. 07 the main working hydraulics of the rotary actuator and its hydraulic lines have been completely isolated from the rigors of the excavating environment with only exterior seals showing, if at all, and no moving (linear) internal parts. This provides for economies of space along the axis 103 and in the remaining body of the coupler C whose volume is now solely occupied by pawl or claw operations.

Figure 8:
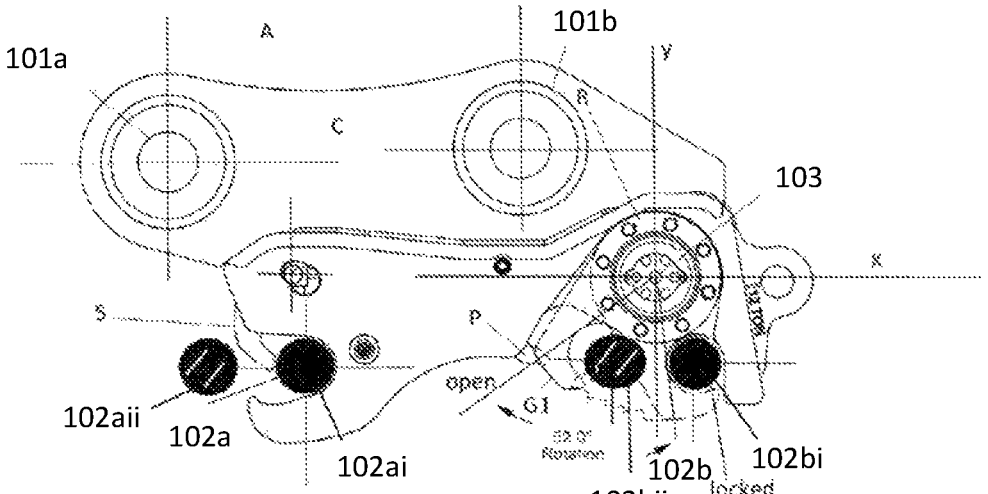
FIG. 08 is a central cross-section of the coupler embodiment of FIG. 07 shown an end view of the rotary hydraulic actuator and the range of relative controlled motion between the coupler and the working tool pin and the coupler framework.

FIG. 08 shows a central vertical cross-section of the rotary cylinder RH of FIG. 07.

Central x-y axis 103 is provided by the central rotating drive shaft of cylinder RH (R in this view) and rotates about axis 103 preferably about 62 degrees from the fully open position to a fully locked position. In this transition pins 102*a* and 102*b* are placed and then driven from positions 102*aii* to position 102*ai* where it may be captured by pawl S. The rotation of claws G1 secure pins 102*b* and drive them from positions 102*bii* to 102*bi*.

Preferably rotary drive RH is only required to work in the range of about 0 to 62 degrees. In the present preferred embodiment the rotary cylinder may be quite short.

Once in position 102*bi* the operation of pawl S rotates pawl P into engagement with ratchet R for mechanical security.

Figure 9:
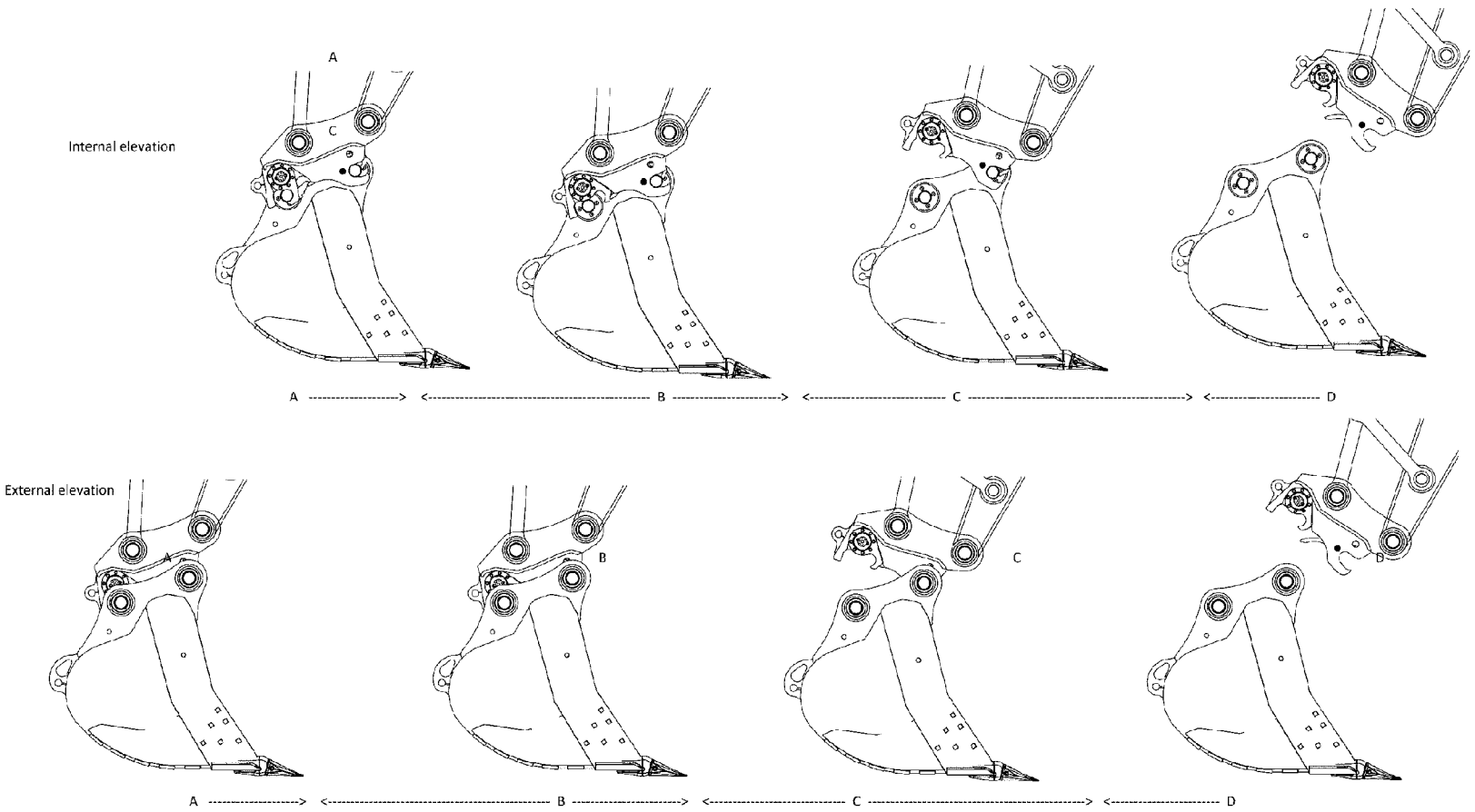
FIG. 09 shows an internal elevation and an external elevation of the A through D sequence of operations of the coupler embodiment of FIG. 07.
Figure 10:
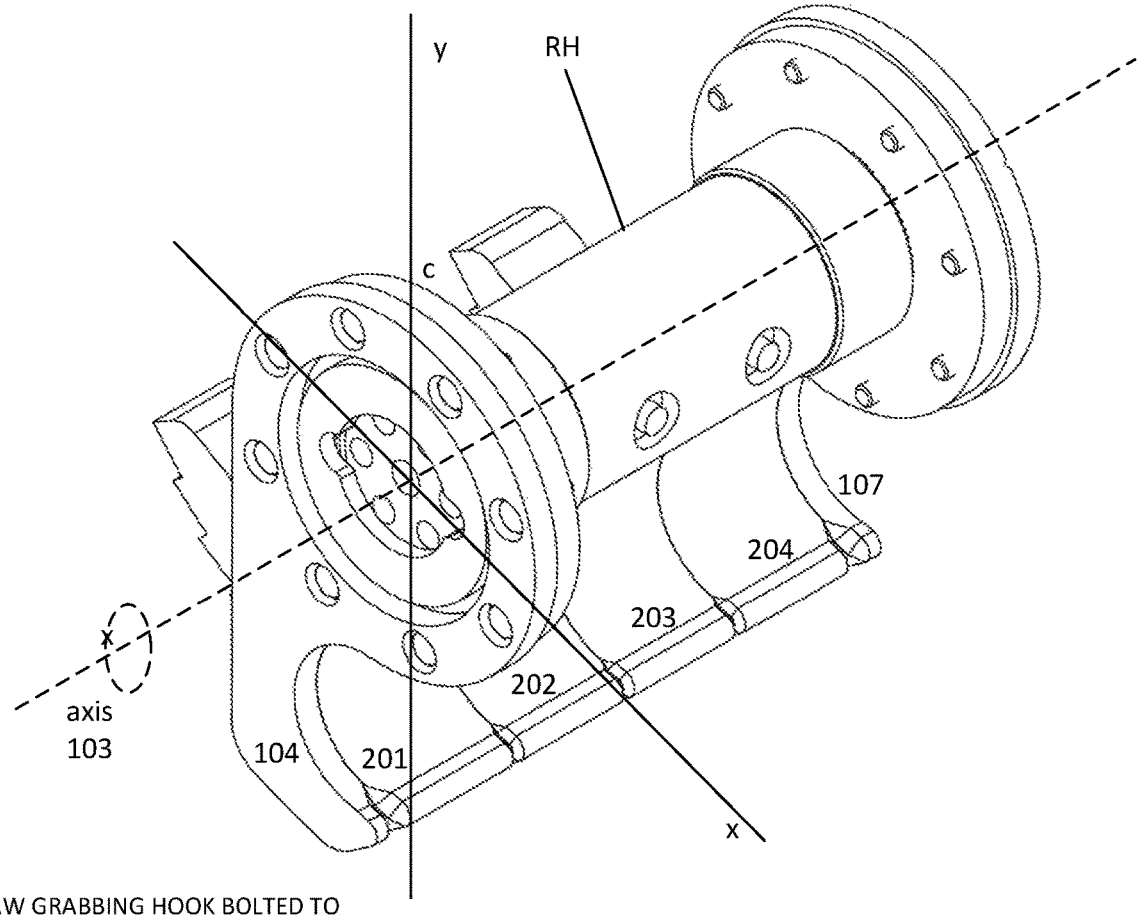
FIG. 10 shows a partial perspective view of the coupler with the grabbing hook claw bolted to rotary actuator flanges and the rotary axle at each end of the axle adjacent the connection flanges.

FIG. 09 shows an internal elevation and an external elevation of the A through D sequence of operations of the coupler embodiment of FIG. 7. FIG. 10 shows another perspective view of the rotary cylinder assembly RH of this embodiment of the invention. Outer tubular structural casing is fixed as by welding to cylinder body as at weldments 106. Claws G1 are shown as elements 104 and 107 at opposite ends of the tubular casing and connection flanges assembly and are fixed to the rotary axle for rotation about axis 103. Between elements 104 and 107 are a pair of ratchet pawls 201 and 203 separated by spacers 202 and 204 and the whole affixed into a single rotating claw assembly supported on the end arms adjacent the connecting flanges and the rotary cylinder axle.

Once the coupler C is encased in its armor cover casing the isolation of the moving components from the work environment is complete and the user is provided with a robust and compact working coupler tool.

It should be understood that components and features provided in respect of one embodiment described herein can be interchanged with corresponding features in other embodiments, insofar as that is physically possible, unless otherwise stated.

The scope of the patent protection sought herein is defined by the accompanying claims. The apparatuses and procedures shown in the accompanying drawings and described herein are examples.

We claim:

1. A hydraulic excavator tool adapted to be secured to an excavator boom comprising:

(a) a main tool assembly including:

i. a main tool framework, ii. a spaced apart pair of connection flanges fast with said main tool framework, and, iii. a structural tubular casing integral with the main tool framework extending across the main tool framework and between the connection flanges, (b) a rotary hydraulic actuator within the tubular casing extending between the connection flanges and adapted to provide a rotational drive motion of a drive axle, (c) the drive axle extending between the connection flanges and being adapted to provide a rotary drive motion of the axle adjacent the connection flanges, and (d) a working tool framework being fast to the drive axle adjacent each of the connection flanges for rotation of the working tool framework about the drive axle between the main tool framework and a working position, the working tool framework being fast to the drive axle by a pair of working arms, the pair of working arms being fast to the drive axle at points external to connection points of the main tool framework to the drive axle and inwardly of side walls of the main tool framework.

2. The hydraulic excavator tool of claim 1, wherein the rotary actuator is fast with the tubular casing adjacent both of the connection flanges.

3. The hydraulic excavator tool of claim 2, wherein drive axle is supported within the rotary actuator adjacent both of the connection flanges.

4. The hydraulic excavator tool of claim 3, wherein the working tool framework is a skeletal framework and the pair of working arms are spaced apart along the direction of the drive axle by at least the length of the tubular casing.

5. The hydraulic excavator tool of claim 4, wherein the working arms are spaced apart by the length of the tubular casing.

6. The hydraulic excavator tool of claim 5, wherein the main tool assembly is adapted to be secured to a distal working end of an excavator boom.

7. The hydraulic excavator tool of claim 5, wherein the drive axle lies between the working tool framework and the distal end of an excavator boom.

8. The hydraulic excavator tool of claim 1, wherein the working tool framework further includes a gap between the pair of working arms, the tubular casing adapted to provide for controlled rotation of the working tool framework through an angle of more than 45 degrees.

9. The hydraulic excavator tool of claim 8, wherein the angle of controlled rotation provided is more than 60 degrees.

10. The hydraulic excavator tool of claim 9, wherein the angle of controlled rotation provided is more than 90 degrees.

11. The hydraulic excavator tool of claim 4, wherein the main tool assembly is an excavator bucket including an array of excavation teeth remote from the axle.

12. The hydraulic excavator tool of claim 11, wherein the connection flanges are positioned inwardly from the side walls of the excavator bucket.

13. The hydraulic excavator tool of claim 12, wherein the working tool framework is a thumb tool.

14. The hydraulic excavator tool of claim 13, wherein the thumb tool is rotatable about the axle from a position in contact with the excavator bucket or the excavation teeth to a non-working position adjacent an excavator boom.

15. The hydraulic excavator tool of claim 4, wherein the main tool assembly is an excavator rake tool including tines extending away from the axle in an array wider than the tubular casing.

16. The hydraulic excavator tool of claim 15, wherein the working tool framework is a secondary rake tool including gripping tines extending away from the axle in an array narrower than the tubular casing.

* * * * *